US006615495B1

(12) United States Patent
Evens et al.

(10) Patent No.: US 6,615,495 B1
(45) Date of Patent: Sep. 9, 2003

(54) APPARATUS AND METHOD FOR PERFORATING PACKAGE COVERINGS

(75) Inventors: Carl J. Evens, Colorado Springs, CO (US); Frank O. McKiel, Colorado Springs, CO (US); Lynda B. Rothschild, N. Potomac, MD (US); Lawrence S. Schimel, Studio City, CA (US)

(73) Assignee: WorldCom, Inc., Clinton, MS (US)

( * ) Notice: Subject to any disclaimer, the term of this patent is extended or adjusted under 35 U.S.C. 154(b) by 0 days.

(21) Appl. No.: 09/430,663

(22) Filed: Oct. 28, 1999

Related U.S. Application Data

(63) Continuation-in-part of application No. 09/300,064, filed on Apr. 27, 1999.

(51) Int. Cl.[7] ..... B26B 29/06
(52) U.S. Cl. ..... 30/289; 30/2; 30/294
(58) Field of Search ..... 30/2, 294, DIG. 3, 30/289, 286, 288, 278, 280, 282

(56) References Cited

U.S. PATENT DOCUMENTS

| | | | | | |
|---|---|---|---|---|---|
| 436,189 | A | * | 9/1890 | Prosinger | 30/289 |
| 1,843,535 | A | * | 2/1932 | Arnold | 30/2 |
| 1,995,887 | A | * | 3/1935 | Kimball | 30/289 |
| 1,996,224 | A | * | 4/1935 | Wedekind | 30/2 |
| 2,204,267 | A | | 6/1940 | Wyres | |
| 2,247,290 | A | * | 6/1941 | Disbrow | 30/2 |
| 2,247,840 | A | | 7/1941 | Harrison | |
| 2,442,694 | A | * | 6/1948 | Keiser | 30/289 |
| 2,520,000 | A | * | 8/1950 | Dettman | 30/294 |
| 2,601,724 | A | * | 7/1952 | Jones | 30/294 |
| 2,688,187 | A | * | 9/1954 | Pauli | 30/289 |
| 2,743,523 | A | * | 5/1956 | Honey | 30/2 |
| 2,776,478 | A | | 1/1957 | Mercer | |
| 2,893,120 | A | | 7/1959 | Mercer | |
| 3,089,238 | A | | 5/1963 | Przybylowicz | |
| 3,123,911 | A | | 3/1964 | Snyder | |
| 3,201,868 | A | * | 8/1965 | Solly | 30/289 |
| 3,383,768 | A | * | 5/1968 | Hamilton | 30/294 |
| 3,791,014 | A | * | 2/1974 | Perna | 30/294 |
| 3,851,687 | A | | 12/1974 | Jones | |
| 3,878,606 | A | | 4/1975 | Hug | |
| 4,001,934 | A | * | 1/1977 | Bell | 30/289 |
| 4,106,196 | A | * | 8/1978 | Smithline | 30/294 |
| D255,981 | S | | 7/1980 | Carbo | |
| 4,473,076 | A | * | 9/1984 | Williams et al. | 30/320 |
| D281,141 | S | | 10/1985 | Butler et al. | |
| 4,569,133 | A | * | 2/1986 | Schmidt | 30/294 |
| 4,757,611 | A | * | 7/1988 | Tommi et al. | 30/2 |
| 5,085,449 | A | | 2/1992 | Hudson | |
| 5,127,161 | A | * | 7/1992 | Ikeda | 30/294 |
| 5,333,381 | A | | 8/1994 | Gelardi et al. | |
| 5,359,776 | A | | 11/1994 | Glazer | |
| D366,407 | S | | 1/1996 | Kendall et al. | |
| 5,555,624 | A | * | 9/1996 | McCracken | 30/2 |
| 5,638,603 | A | | 6/1997 | Li | |
| 5,666,731 | A | * | 9/1997 | Rungren | 30/289 |
| 5,992,286 | A | * | 11/1999 | Boole | 30/294 |
| D419,417 | S | | 1/2000 | Kane | |

FOREIGN PATENT DOCUMENTS

| | | |
|---|---|---|
| GB | 228709 | 2/1925 |

* cited by examiner

*Primary Examiner*—Stephen Choi

(57) ABSTRACT

A packaging cutter for the safe and effective perforation of packaging materials on packages or other containers comprises a body and a cutting mechanism housed within the body. The body comprises two side walls and a top wall defining an interior volume in which the packaged container is positioned during the cutting process. The cutting mechanism is mounted in or to the top wall. The packaging cutter also comprises a depth setting mechanism to prevent cutting of the package or container itself.

9 Claims, 5 Drawing Sheets

APPARATUS AND METHOD FOR PERFORATING PACKAGE COVERINGS

CROSS-REFERENCE

The present invention is a continuation-in-part of U.S. patent application Ser. No. 09/300,064 filed Apr. 27, 1999 and which is currently pending.

BACKGROUND OF THE INVENTION

1. Field of the Invention

The present invention relates to hand held cutters for opening containers and more particularly to hand held label/packaging cutters for perforating labels, adhesives, coverings and the like affixed to containers such as compact disk containers.

2. Discussion of the Related Art

Currently, many consumer goods are packaged in specially molded containers. The containers are generally tightly wrapped in a clear, highlighted wrapping such as cellophane and the like. In addition, a security, advertisement and/or other identification tab or label is usually attached to the package or wrapper with a powerful adhesive in order to prevent the tab or label from being inappropriately or inadvertently removed. An unfortunate by-product of modem packaging is the difficulty encountered by the consumer or bearer of the package in removing the packaging, tab and/or label. In order to remove such coverings, a person must somehow perforate the particular covering thereby allowing the person to tear through the covering so as to facilitate complete removal from the package.

A variety of techniques are employed for perforating package coverings. Such techniques include using a sharp object, such as a knife blade, a finger nail, and the like, to pierce the covering. These techniques have some obvious drawbacks including the dangers of using a knife, the possibility of hurting or breaking a fingernail and/or the unavailability of a suitably strong and sharp implement. Likewise, one should be ever cautious about not hurting oneself or damaging the package (and/or its contents) with the sharp implement when perforating the coverings.

One common culprit of tight, difficult to remove packaging is the modem compact disk or CD. CDs have become a chief source of music for millions of people worldwide. CDs may be purchased from a variety of sources ranging from the traditional music or specialty store to large department stores to catalog or on-line services. CDs come neatly packaged in a prefabricated plastic container molded to snugly hold a CD therein. The container is tightly wrapped in clear plastic, cellophane, or the like. The CD package further includes a security tab or label snugly affixed to either the package or the cellophane/plastic covering so as to prevent inappropriate or inadvertent removal. Advertising and other identifying tabs or labels may also be directly affixed to the CD package. As is known in the art, the security tag causes an alarm to sound if the tag is not deactivated prior to departure from predefined premises (such as a music store). While the security tags (and other labels) are an effective deterrent to shoplifters, the tags present a formidable obstacle to opening the CD package, even to the lawful owner. Likewise, the clear plastic and/or cellophane covering can be equally challenging in its removal. Therein, not only would one want to remove the coverings, one would want to perform the removal without damaging the package or hurting oneself. Therefore, a need exists in the art for a safe, easy to use, convenient and easily portable package opener that easily removes packaging including cellophane, security tabs and other affixed labels without damaging the package or hurting the user.

SUMMARY OF THE INVENTION

The packaging cutter of the present invention provides a means for avoiding the difficulties discussed above.

In accordance with one aspect, the present invention is directed to a packaging cutter. The packaging cutter comprises a body, a combined cutting device mount and depth setting mechanism mounted in the body and a cutting device mounted in the combined cutting device mount and depth setting mechanism. The body defines an interior volume in which a packaged container is positioned. The cutting device perforates and cuts the packaging material of the packaged container.

In accordance with another aspect, the present invention is directed to a packaging cutter. The packaging cutter comprises a body and a cutting mechanism/safety device housed within the body. The body defines an interior volume in which a packaged container is positioned. The cutting mechanism/safety device combination perforates and cuts the packaging material of the packaged container and prevents accidental contact with the cutting device when not in use.

The present invention is directed to an apparatus and method for perforating package coverings. The present invention brings a cutting implement, such as a metal or plastic blade or any other suitable cutting device, close to an adhesive label or other packaging material. The blade is designed to perforate the label or other packaging material by corresponding application of force on the apparatus. Once the label is perforated, the present invention is manually moved so as to complete a lengthwise perforation of the label or other packaging material. By this operation, the user need not bother with other less effective manual techniques for breaking or otherwise removing a label or other packaging, as briefly described above.

The packaging cutter of the present invention provides a safe and effective means for removing the packaging material from a variety of containers. The packaging cutter is easy to utilize, lightweight and compact, it is easy to carry and may be utilized as a key chain or the like. The packaging cutter is also inexpensive.

BRIEF DESCRIPTIONS OF THE DRAWINGS

The foregoing and other features and advantages of the invention will be apparent from the following, more particular description of preferred embodiments of the invention, as illustrated in the accompanying drawings. In the drawings, like reference numbers indicate identical or functionally similar elements. Additionally, the left most digit of a reference number indicates the drawing in which the reference number first appears.

Figure 5:
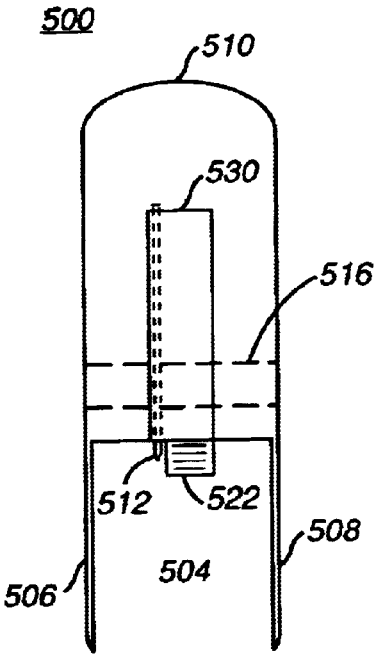
FIG. 5 is an end view of an exemplary embodiment of the packaging cutter of the present invention having a combined cutting device mount and depth setting mechanism.
Figure 5A:
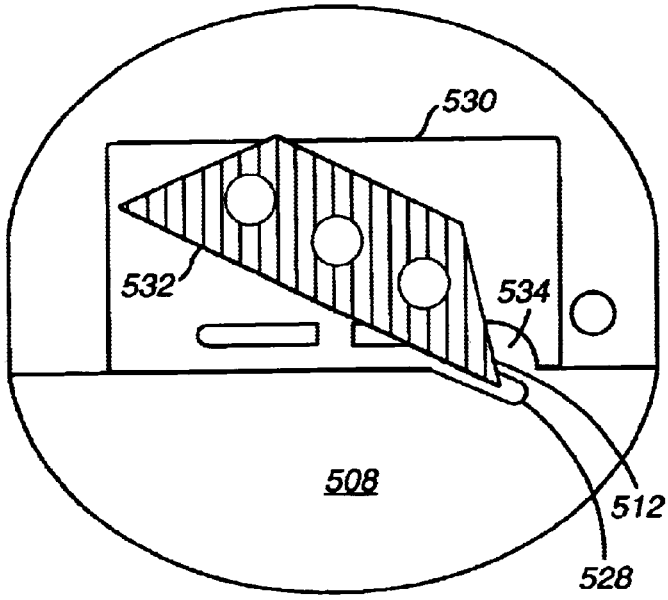

FIG. 5*a* is a diagrammatic representation of the packaging cutter having a combined cutting device mount and depth setting mechanism in accordance with the present invention.

Figure 5B:
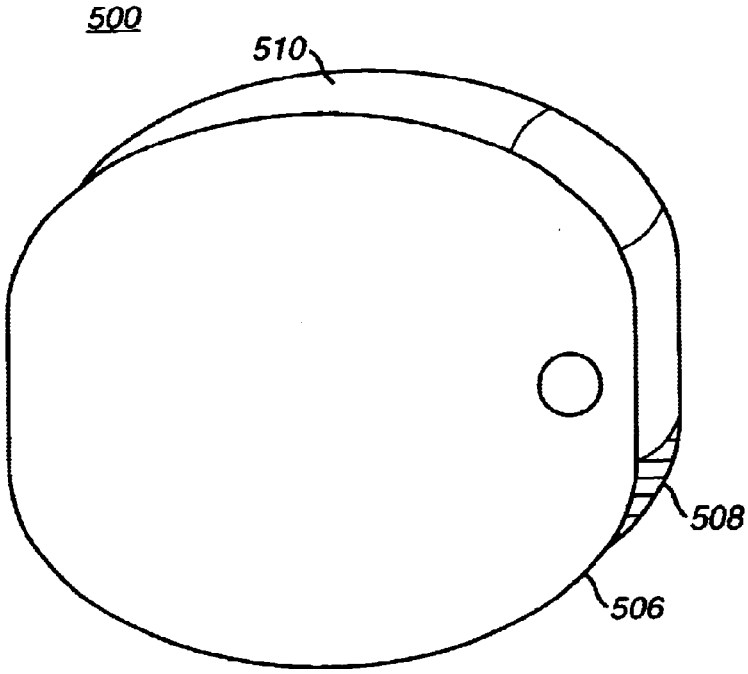

FIG. 5*b* is a side view of the exemplary embodiment of the packaging cutter illustrated in FIG. 5.

Figure 6A:
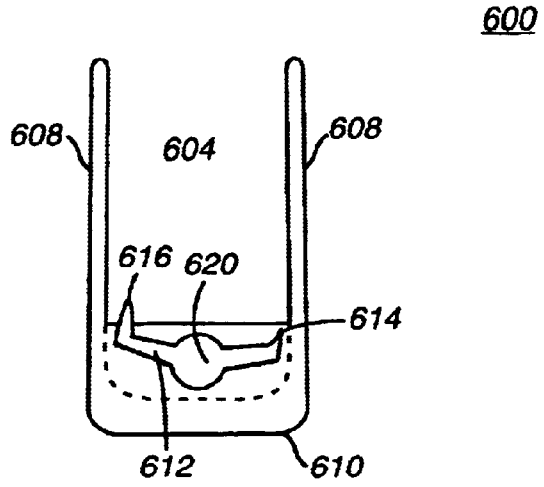

FIG. 6*a* is an end view of an exemplary embodiment of the packaging cutter of the present invention having a cutting mechanism/safety device combination.

Figure 6B:
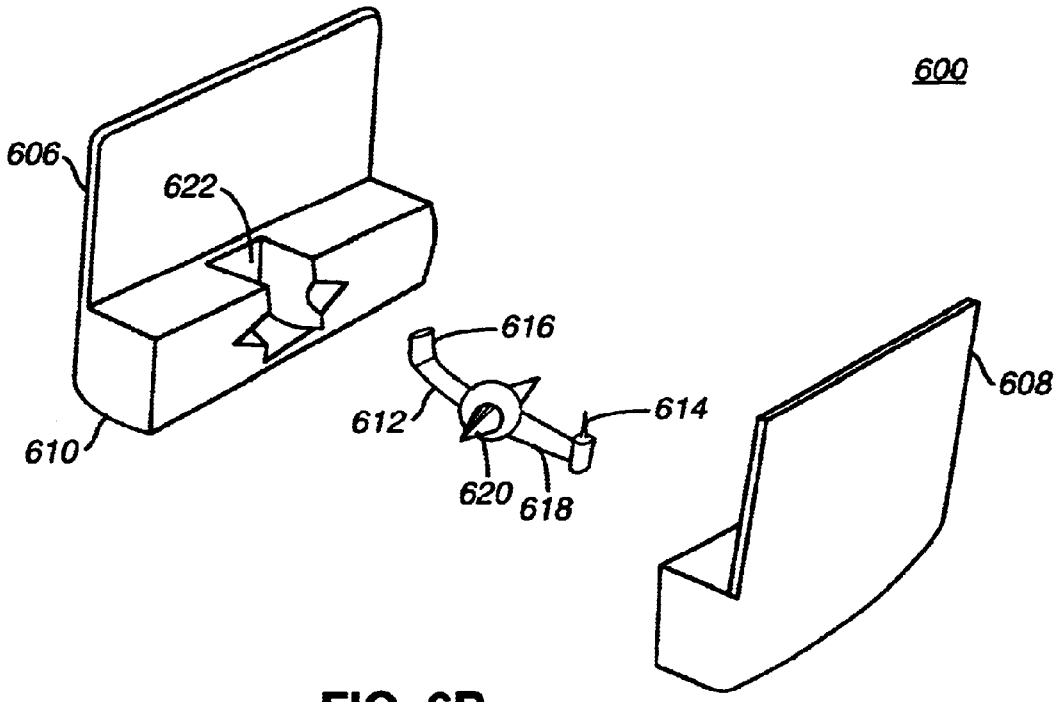

FIG. 6*b* is a diagrammatic representation of the packaging cutter having a cutting mechanism/safety device combination in accordance with the present invention.

DETAILED DESCRIPTION OF THE PREFERRED EMBODIMENTS

The packaging cutter of the present invention may be utilized to safely and efficiently remove packaging material from a variety of containers. The packaging cutter comprises a uniquely simple design. The packaging cutter comprises a body and a cutting mechanism. The body defines an interior volume in which the container is positioned and is designed for safe and easy use, and the cutting mechanism, which is housed within the body, is designed to cut only the packaging material and not the container or user. As is explained in detail subsequently, the packing cutter may be sized to accommodate various size containers, including CDs and video cassette containers.

Figure 1:
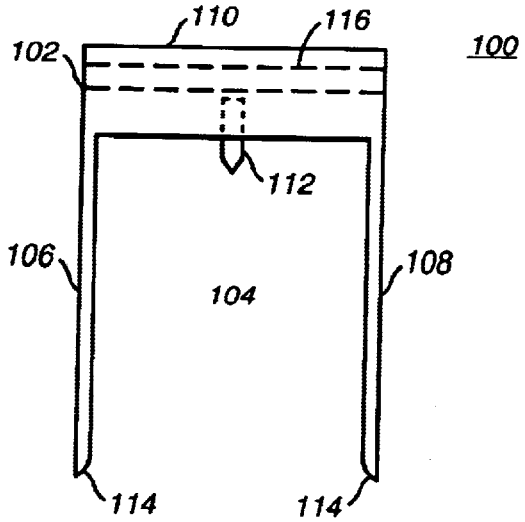
FIG. 1 is an end view of an exemplary embodiment of the packaging cutter of the present invention.

FIG. 1 is an end view of an exemplary embodiment of the packaging cutter 100 of the present invention. As illustrated, the packaging cutter 100 comprises a substantially U-shaped body 102 defining an interior volume 104 in which the packaged container is positioned during the cutting process. The substantially U-shaped body 102 includes first and second side walls 106, 108 and a top wall 110. The first and second side walls 106, 108 are substantially parallel and extend substantially perpendicular from the top wall 110. The packaging cutter 100 also comprises a cutting device 112 mounted in or to the top wall 110. Although the first and second side walls 106, 108 are shown and described as substantially parallel, other configurations are possible. For example, the side walls may be tapered to provide a snug fit around the container. In yet another alternate embodiment, the side walls may be slightly concave. A more detailed description is given subsequently. Other configurations may be utilized and will be readily apparent to the skilled artisan. The substantially U-shaped body 102 is preferably formed as a unitary structure. In other words, the substantially U-shaped body 102 is a preferably one piece structure.

The substantially U-shaped body 102 may be formed from any suitably rigid and strong material able to withstand the forces applied thereto when utilizing the cutter 100 as described in detail subsequently. For example, the substantially U-shaped body 102 may be formed form various strong and lightweight materials such as aluminum, fiberglass or various plastics. In the preferred embodiment, the substantially U-shaped body 102 is formed from a substantially rigid plastic having a smooth finish to facilitate movement of the cutter 100 over the package and which promotes a favorable tactile response from the user. While the packaging cutter 100 illustrated in FIG. 1 comprises a substantially U-shaped body, it is important to note that the body may comprise any shape or configuration. The cutting device 112 may comprise any suitable instrument for cutting packaging materials such as plastic wrap and paper. The cutting device 112 preferably comprises a razor sharp blade formed from a material which maintains its edge after repeated use, such as steel. Alternately, a pin point cutting device may also be utilized. The overall size of the substantially U-shaped body 102 is preferably sufficient for providing stability during the cutting process and sufficient area for the user to obtain a firm grip. In addition, the size of the U-shaped body 102 may be varied to change the interior volume 104 defined thereby to accommodate different size containers.

Figure 1A:
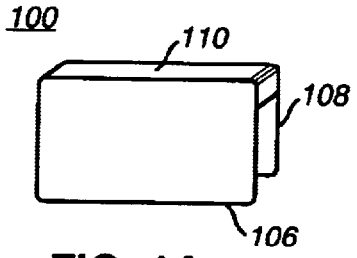
FIG. 1A is a side view of an exemplary embodiment of the packaging cutter of the present invention.
Figure 1B:
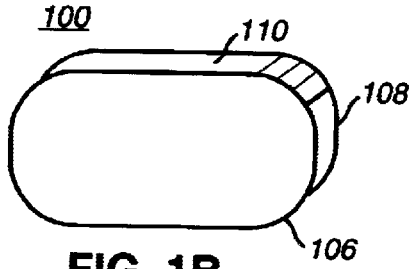
FIG. 1B is a side view of another exemplary embodiment of the packaging cutter of the present invention.

The first and second side walls 106, 108 may be spaced apart a distance sufficient to accommodate various sized packages in the interior volume 104 defined thereby. In a preferred embodiment, the first and second side walls 106, 108 are spaced apart a distance sufficient to provide a snug fit for the container positioned therebetween. Accordingly, cutters designed to open the packaging material on different size containers would have walls spaced to accommodate the various containers. It is important to note, however, that the walls do give somewhat and slightly larger containers may fit therein. The width of the side walls 106, 108 i.e. the distance the first and second side walls 106, 108 is preferably sufficient to prevent an adult or child from extending any part of his/her anatomy into the interior volume 104 and making contact with the cutting device 112. In addition, the distance is preferably sufficient to provide support for the packaging cutter 100 during the cutting process. The length of the side walls 106, 108 may be any suitable length to provide support during the cutting process and to provide sufficient area for the user to obtain a firm grip. The thickness of the side walls 106, 108 depends on the materials utilized to form the substantially U-shaped body 102 of the packaging cutter 100. The side walls 106, 108 are preferably thick enough to provide support during the cutting process. The side walls 106, 108 may comprise any shape, for example, as illustrated in FIG. 1A, the side walls 106, 108 may comprise a substantially rectangular shape, or as illustrated in FIG. 1B, the side walls 106, 108 may comprise a substantially oval shape.

Figure 1C:
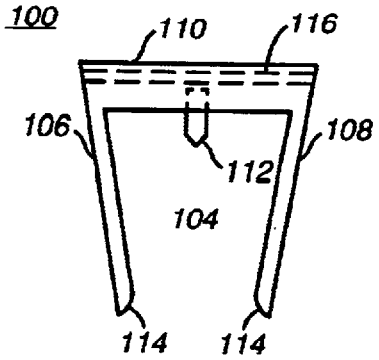
FIG. 1C is an end view of another exemplary embodiment of the packaging cutter of the present invention.
Figure 1D:
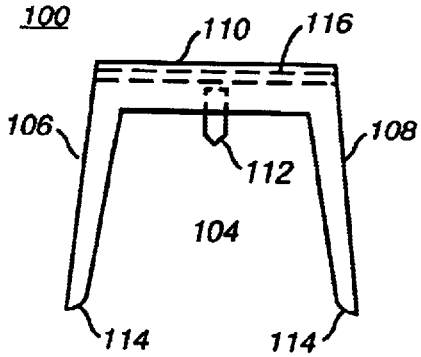
FIG. 1D is an end view of another exemplary embodiment of the packaging cutter of the present invention.
Figure 1E:
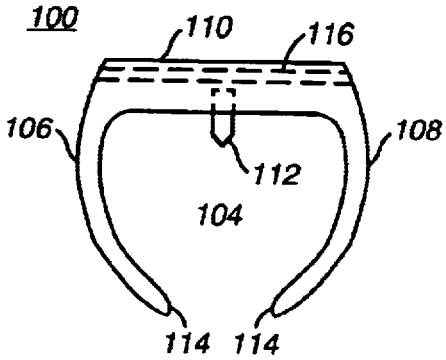
FIG. 1E is and end view of another exemplary embodiment of the packaging cutter of the present invention.

As discussed above, the side walls 106, 108 are substantially parallel to one another; however, other configurations are possible. For example, as illustrated in FIGS. 1C and 1D the side walls 106, 108 may be slightly tapered. In FIG. 1C, the side walls 106, 108 are spaced apart from one another less proximate the top wall 110 and further apart at their distal ends. In FIG. 1D, the side walls 106, 108 are tapered in the opposite direction as is illustrated in FIG. 1C. In yet another alternate configuration, the side walls 106, 108 may be slightly concave as illustrated in FIG. 1E. Other configurations are possible can will be readily apparent to the skilled artisan.

Regardless of the spacing between or the shape of the side walls 106, 108, the distal ends of the side walls 106, 108 are preferably configured to allow easy insertion of the container into the interior volume 104 defined thereby. In the preferred embodiment, the distal ends of the side walls 106, 108 comprise a slightly tapered lip 114 to allow easy insertion of a container as illustrated in FIG. 1.

The top wall 110 of the packaging cutter 100 preferably has a thickness to provide sufficient structural support to withstand the forces generated during use. In addition, the top wall 110 preferably has a thickness to accommodate the secure mounting of the cutting device 112 thereto. The top wall 110 may comprise any suitable shape. For example, the top wall 110 may comprise a semi-circular cross-section or an oval cross-section. In the exemplary embodiment, the top wall 110 comprises a substantially rectangular cross-section.

The top wall 110 may also comprise a hole 116 therethrough. The hole 116 may be positioned anywhere in the top wall 110 which does not interfere with the operation of the packaging cutter 100. The hole 116 may be utilized for any number of purposes. For example, the hole 116 may be utilized to position a string, chain or other suitable means for connecting the packaging cutter 100 to keys or the like. The hole 116 may be lined with a protective material to protect the top wall 110 from abrasions due to movement of the chain or string.

As stated above, the cutting device 112 may comprise any cutting instrument capable of cutting various packaging materials. In one exemplary embodiment, the cutting device 112 comprises a razor blade mounted in the top wall 110. The razor blade 112 may be mounted to the top wall 110 in any number of ways. For example, in one exemplary embodiment, the razor blade 112 may be removably mounted to the top wall 110 so that it may be replaced when and if the cutting edge dulls. The length of the razor 112 is preferably less than the length of the top wall 110 and more preferably much shorter then the length of the top wall 110 so as to prevent an individual from making contact therewith. The razor blade 112 may be positioned at various locations on the top wall 110. In the preferred embodiment, the razor blade 112 is centrally positioned on the top wall 110.

Figure 2:
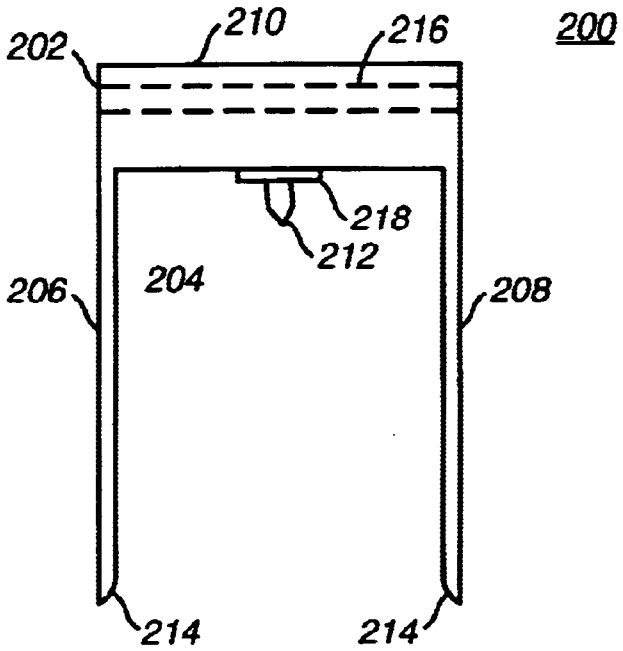
FIG. 2 is an end view of an exemplary embodiment of the packaging cutter having a removable cutting device in accordance with the present invention.

In the exemplary embodiment illustrated in FIG. 1, the razor blade 112 is permanently mounted in the top wall 110. Any number of manufacturing techniques may be utilized to mount and securely hold the razor blade 112 in the top wall 110. As stated above, in an alternate embodiment, the razor blade 112 may be removably mounted to the top wall 110 to facilitate replacement. The razor blade may be removably mounted in any number of ways. As illustrated in FIG. 2, the razor blade 212 may comprise a mounting flange 218 which is preferably secured to the top wall 210 via fastening devices. Preferably, the fastening devices are removable, for example, screws or the like.

Regardless of whether the razor blade is permanently or removably mounted to the top wall, the cutting surface of the razor blade preferably only extends from the surface of the top wall a distance sufficient to cut only the packaging material and not the container or package. Accordingly, different types of packaging materials may require different depths of cuts. In the case where the razor blade is permanently mounted, the depth of cut is set by the depth at which the razor blade is mounted in the top wall. As stated above, any number of manufacturing techniques may be utilized to permanently mount the razor blade 112 to the top wall 110. For example, the razor blade 112 may be inserted directly into the material forming the top wall 110 when the material is in a liquid or molten state. Alternately, the razor blade 112 may be mounted in a deformable material such as rubber or the like, which in turn would be mounted to the top wall 110. The deformable material may be mounted to the top wall 110 utilizing an adhesive or the like. Since the material is deformable, the razor blade 112 would give slightly during use. In the case when the razor blade is removably mounted, the depth may be adjusted by various means, including the use of spacers.

Figure 3:
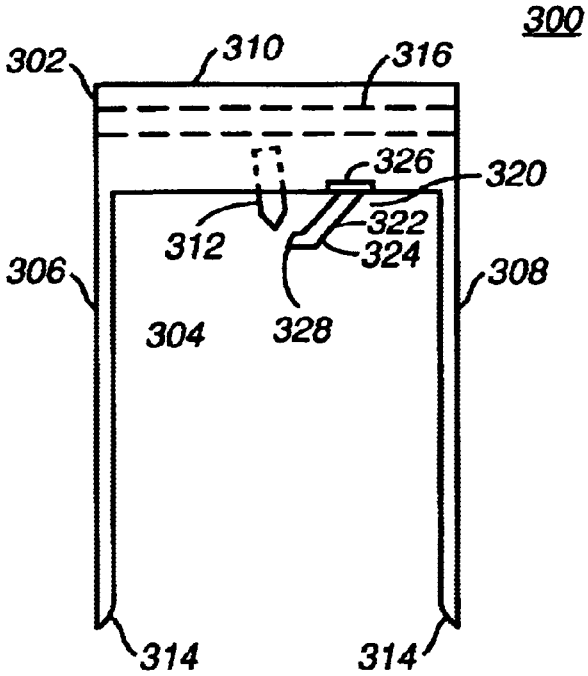
FIG. 3 is a diagrammatic representation of a depth setting mechanism of the packaging cutter of the present invention.

In yet another alternate embodiment, the packaging cutter of the present invention may comprise a depth setting mechanism. FIG. 3 illustrates one exemplary embodiment of a depth setting mechanism 320. The depth setting mechanism 320 comprises a cantilevered arm 322. The cantilevered arm 322 is connected to the top wall 310 and extends from the top wall 310 to a point such that its distal end 324 is even with or extends slightly past the razor blade 312. In the preferred embodiment, the distal end 324 extends slightly past the cutting surface of the razor blade 312 thereby providing extra protection for the user and preventing accidental or premature cutting of the packaging material. The cantilevered arm 322 may be formed from a flexible material such that when a downward pressure is applied during use, the package or container forces the cantilevered arm 322 towards the top wall 310 thereby exposing the cutting surface of the razor blade 312 to the packaging material. The amount of force applied by the user determines how much of the cutting surface of the razor blade 312 is exposed which in turn determines the depth of the cut. The top wall 310 may comprise a recess 326 into which the cantilevered arm 322 may travel. The cantilevered arm 322 may be formed from any suitably flexible material which exhibits spring-like qualities and returns to its normally extended position when the downward force is removed. The cantilevered arm 322 may be attached to the top wall 312 in any number of ways depending on the materials utilized and the manner in which the packaging cutter is manufactured. The distal end 324 may comprise a lip 328 which allows the packaging cutter to be used in only a single direction. In this case, a directional arrow or some other indication of direction of use may be placed on one or more locations on the packaging cutter. The lip 328 may also be designed to allow the packaging cutter to be used in any direction.

In an alternate embodiment, the depth setting mechanism may comprise two cantilevered arms, one on each side of the razor blade to provide additional stability. In addition, the depth setting mechanism may be a modular unit which may be easily removed from the top wall. In yet another alternate embodiment, the depth setting mechanism and the cutting device together may be a modular unit which may be easily removed from the top wall.

As stated above, the packaging cutter of the present invention may be formed from any of a number of suitable materials. The type of materials selected may determine how the packaging cutter is fabricated. The packaging cutter may be fabricated in any number of ways including machining and injection moulding. The materials utilized and the method of fabrication will readily suggest themselves to those skilled in the relevant art.

Figure 4:
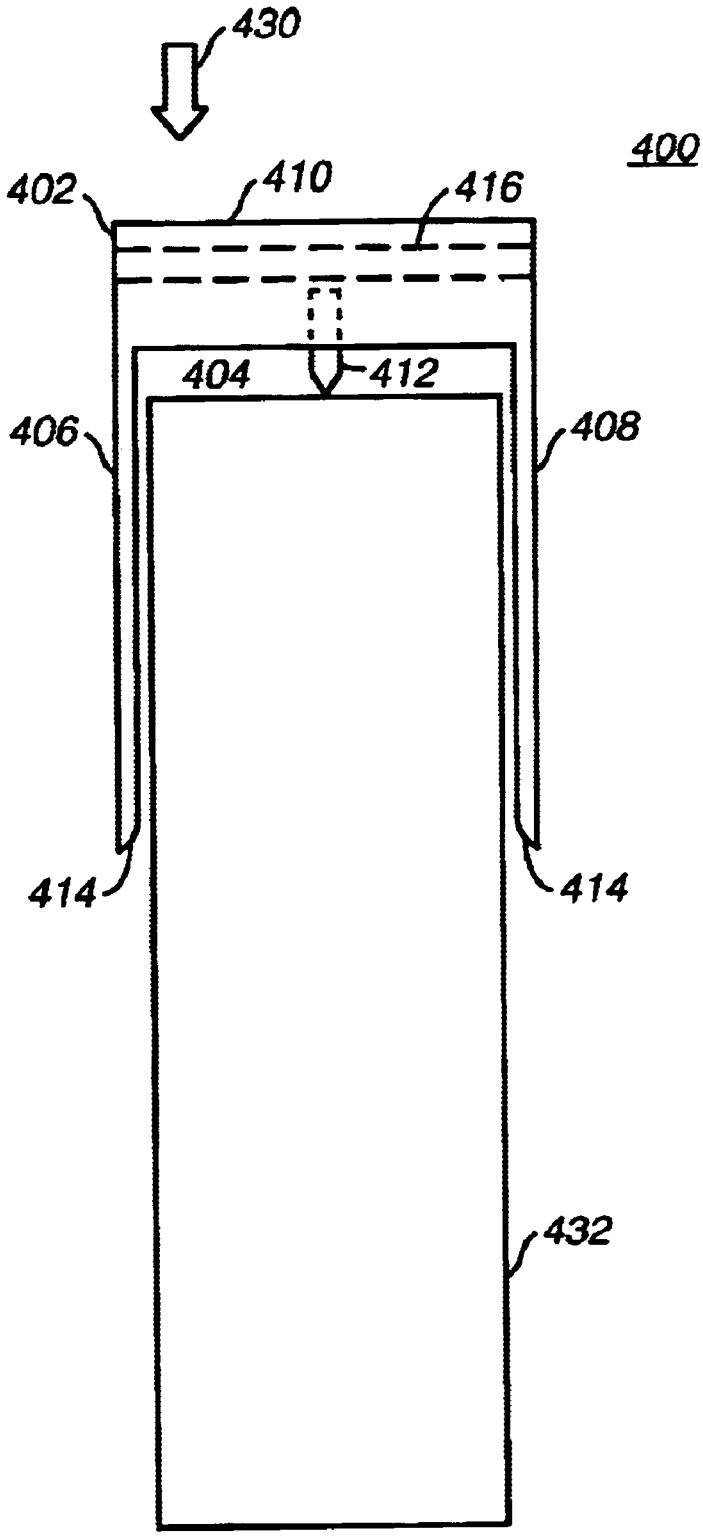
FIG. 4 is a diagrammatic representation of the packaging cutter with a package in accordance with the present invention.

The operation of the packaging cutter will now be described with reference to FIG. 4. The intention, when using the present invention, is to bring the cutting device 412 proximate to the packaging material on the particular container 432, in this example a CD, and then cause the cutting device 412 to pierce or perforate the packaging. The perforating action may be assisted by a downward force manually applied to the packaging cutter 400 as indicated by arrow 430. The cutting device 412 is caused to perforate the packaging and stop at the surface of the package 432. The cutting device 412 is not intended, nor should sufficient manual force be applied thereto, to perforate the package 432 itself or otherwise cause damage thereto.

In an alternate exemplary embodiment, the breaking point of the cutting device 412 may be limited to less than the breaking point of the package or container 432. Essentially, the applied force that would damage the package or container is much greater than the force that would break the cutting device 412. In this embodiment, should the user apply excessive force, the cutting device 412 would give way prior to damaging the package 432. Other embodiments for setting the depth of the cut have been discussed above.

After the cutting device 412 has perforated the packaging, the packaging cutter 400 is moved in a lateral direction, to the package 432, so as to cut a line through the top of the packaging. The package 432 is thereafter removed from the interior with the packaging now sufficiently perforated so as to facilitate easy manual removal. It should be understood that the above steps may be modified, without departing from the intentions thereof which is to bring the cutting device 412 to the portion of the package 432 to be perforated and manually cause the cutting device to perforate that portion.

In yet another alternate embodiment, the packaging cutter of the present invention may comprise a combined cutting device mount and depth setting mechanism as illustrated in FIGS. 5, 5*a* and 5*b*. The combined cutting device mount and depth setting mechanism 530 comprises a blade recess 532 into which the razor blade 512 is mounted. In the exemplary embodiment, the razor blade 512 is positioned such that only a small portion of the cutting surface extends from the combined cutting device mount and depth setting mechanism 530 in a manner analogous to a utility knife. The amount the razor blade 512 extends and the angle of cut may be varied by changing the angle of the blade recess 532 and its position in the combined cutting device mount and depth setting mechanism. The combined cutting device mount and depth setting mechanism 530 also comprises a cantilevered arm 522. The cantilevered arm 522 extends from the bottom surface of the combined cutting device mount and depth setting mechanism 530 to a point past the razor blade 512, thereby protecting any object from inadvertently contacting the cutting surface of the razor blade 512. The cantilevered arm 522 may be formed from a flexible material such that when a downward pressure is applied during use, the package or container forces the cantilevered arm 522 upward thereby exposing the cutting surface of the razor blade 512 to the packaging material. The amount of force applied by the user determines how much of the cutting surface of the razor blade 512 is exposed which in turn determines the depth of the cut. The combined cutting device mount and depth setting mechanism 530 comprises a recess 534 into which the cantilevered arm 522 moves when force is applied thereto.

For larger packages the space between the side walls has to be greater. Accordingly, there is a greater risk of an individual making inadvertent contact with the cutting device. FIGS. 6*a* and 6*b* illustrate an exemplary embodiment of a packaging cutter 600 which may be utilized to open larger packages such as those utilized for video cassettes. As illustrated, the exemplary packaging cutter 600 comprises the same basic configuration as the previously described exemplary embodiments; namely, first and second side walls 606, 608 and a top wall 610 defining an interior volume 604. The packaging cutter 600 also comprises a cutting mechanism/safety device combination 612. The cutting mechanism/safety device combination 612 comprises a perforating stylus 614, a sensor 616, a lever 618 and a fulcrum 620. The perforating stylus 614 is mounted to one end of the lever 618 and the sensor 616 is mounted to the other end of the lever 618. The cutting mechanism/safety device combination 612 may be mounted in a recess 622 in the top wall 610 such that the lever 618 is free to pivot on the fulcrum 620.

The cutting mechanism/safety device combination 612 is preferably designed such that when the packaging cutter is not in use, the sensor 616 extends from the recess 622 while the perforating stylus 614 is safely out of reach in the recess 622. When a container is positioned in the interior volume 604 and makes contact with the sensor 616, the contact preferably forces the sensor 616 into the recess 622 thereby forcing the perforating stylus 614 out of the recess 622 into contact with the packaging material on the container. Once the perforating stylus 614 makes contact with the packaging material, the packaging cutter 600 may be utilized as described above.

The cutting mechanism/safety device combination 612 may comprise any suitable configuration. For example, the perforating stylus 614 may comprise any suitable device for perforating packaging material and may be attached to the lever 618 by any suitable means. The sensor 616 may comprise any suitable means for safely making contact with objects. The sensor 618 may be formed as a part of the lever 618 or may be a separate part attached to the lever 618 by any suitable means. In the exemplary embodiment, the cutting mechanism/safety device combination is designed such that the perforating stylus 614 extends from the recess 622 when the sensor 616 is forced into the recess 622. The cutting mechanism/safety device combination 612 may be formed from any suitable materials and may be mounted in the recess by any suitable means.

The cutting mechanism/safety device combination 612 is preferably biased such that the sensor 616 extends from the recess 622 when the cutter 600 is not in use. The bias may be achieved in any number of ways. For example, the sensor 616 or the sensor end of the lever 618 may be weighted less than the perforating stylus 614 or stylus end of the lever 618. Alternately, a spring may be utilized to bias the combination 612.

Although shown and described is what is believed to be the most practical and preferred embodiments, it is apparent that departures from specific designs and methods described and shown will suggest themselves to those skilled in the art and may be used without departing from the spirit and scope of the invention. The present invention is not restricted to the particular constructions described and illustrated, but should be constructed to cohere with all modifications that may fall within the scope of the appended claims.

What is claimed is:

1. A packaging cutter comprising:

a body defining an interior volume in which a packaged container is positioned, the body further comprising a top wall and first and second side walls;

a combined cutting device mount and cut depth setting mechanism mounted in the body, the combined cutting mount and cut depth setting mechanism further comprising a cutting device recess, a cantilevered arm that extends from a bottom surface of the combined cutting device mount and cut depth setting mechanism and a recess that the cantilevered arm will travel upon application of force upon the cantilevered arm; and a cutting device having a base end and a blade end opposite said base end, the cutting device mounted in the cutting device recess located in the combined cutting device mount and cut depth setting mechanism for perforating and cutting the packaging material of the packaged container, wherein the motion of the cantilevered arm is substantially parallel to a plane formed between the base end and blade end of the cutting device and wherein a surface of said cutting device and the cantilevered arm are spaced apart a substantially constant distance at all times.

2. The packaging cutter according to claim 1, wherein the body is formed as a unitary structure.

3. The packaging cutter according to claim 2, wherein the combined cutting device mount and depth setting mechanism is mounted in the top wall.

4. The packaging cutter of claim 1, wherein the cantilevered arm comprises a fixed end and a free end.

5. The packaging cutter of claim 4, wherein the free end of the cantilevered arm is proximate to the blade end of the cutting device and wherein the blade end is positioned at a distance from the bottom surface of the combined cutting device mount and cut depth setting mechanism that is less than the distance that the free end of the cantilevered arm is from the bottom surface of the combined cutting device mount and depth setting mechanism when the cantilevered arm is in an unbiased position.

6. A packaging cutter comprising:

a body defining an interior volume in which a packaged container is positioned, the body further comprising a top wall and first and second side walls; and a mechanism housed within the body for perforating the packaging of the packaged container and preventing accidental contact when not in use, the mechanism further comprises a cutting device, a cantilevered arm that extends from a bottom surface of the body and a recess that the cantilevered arm will travel upon application of force upon the cantilevered arm, wherein the cutting device has base end and a blade end opposite to said base end, the motion of the cantilevered arm is substantially parallel to the a plane formed between the base end and the blade end of the cutting device and wherein a surface of said cutting device and the cantilevered arm are spaced apart a substantially constant distance at all times.

7. The packaging cutter according to claim 6, wherein the body is formed as a unitary structure.

8. The packaging cutter of claim 6, wherein the cantilevered arm comprises a fixed end and a free end.

9. The packaging cutter of claim 8, wherein the free end of the cantilevered arm is proximate to the blade end of the cutting device and wherein the blade end is positioned at a distance from the bottom surface of the body that is less than the distance that the free end of the cantilevered arm is from the bottom surface of the body when the cantilevered arm is in an unbiased position.

* * * * *